US008132547B2

(12) United States Patent
Guerrero et al.

(10) Patent No.: US 8,132,547 B2
(45) Date of Patent: Mar. 13, 2012

(54) THERMAL ENERGY MANAGEMENT SYSTEM FOR A VEHICLE HEAT ENGINE PROVIDED WITH A TIME-DELAY SWITCHING MEANS

(75) Inventors: Pascal Guerrero, Rueil-Malmaison (FR); Philippe Jouanny, Guyancourt (FR); Ngy Srun Ap, Saint Remy Les Chevreuse (FR)

(73) Assignee: Valeo Systemes Thermiques, Les Mesnil Saint Denis (FR)

( * ) Notice: Subject to any disclaimer, the term of this patent is extended or adjusted under 35 U.S.C. 154(b) by 976 days.

(21) Appl. No.: 11/793,970

(22) PCT Filed: Dec. 23, 2004

(86) PCT No.: PCT/FR2004/003360

§ 371 (c)(1),
(2), (4) Date: Jul. 30, 2008

(87) PCT Pub. No.: WO2006/070080

PCT Pub. Date: Jul. 6, 2006

(65) Prior Publication Data

US 2009/0283060 A1 Nov. 19, 2009

(30) Foreign Application Priority Data

Dec. 22, 2003 (FR) ..... 03 15138

(51) Int. Cl.
*F01P 3/00* (2006.01)

(52) U.S. Cl. ..... 123/41.29; 123/41.15

(58) Field of Classification Search ..... 123/41.01, 123/41.02, 41.1, 41.12, 41.13, 41.15, 41.29
See application file for complete search history.

(56) References Cited

U.S. PATENT DOCUMENTS

| | | | | |
|---|---|---|---|---|
| 4,317,439 | A * | 3/1982 | Emmerling | 123/563 |
| 5,353,757 | A | 10/1994 | Susa et al. | |
| 5,394,854 | A * | 3/1995 | Edmaier et al. | 123/563 |
| 5,765,511 | A * | 6/1998 | Schatz | 123/41.14 |
| 6,604,515 | B2 * | 8/2003 | Marsh et al. | 123/563 |
| 7,140,330 | B2 * | 11/2006 | Rogers et al. | 123/41.14 |

FOREIGN PATENT DOCUMENTS

FR 2667020 3/1992

OTHER PUBLICATIONS

International Search Report issued in International Application No. PCT/FR2004/003360 mailed on Jun. 15, 2005, with translation (4 pages).

* cited by examiner

*Primary Examiner* — Michael Cuff
*Assistant Examiner* — Hung Q Nguyen
(74) *Attorney, Agent, or Firm* — Osha • Liang LLP

(57) ABSTRACT

The inventive management system comprises a high-temperature circuit (12) provided with a high-temperature cooling radiator (20), a low-temperature circuit (14) provided with a low-temperature cooling radiator (30, 30*a*, 30*b*), wherein the same heat carrier fluid runs through said circuits. Said system also comprises a radiator (36) assignable to first switching means (52) and to second switching means (54) for switching the system from a connected configuration, in which the assignable radiator (36) is connected to the low-temperature circuit (14), to a disconnected configuration, in which the assignable radiator is connected to the high-temperature circuit (12), and vice-versa. The switching means are sequentially actuated after a time-delay during switching from the disconnected configuration to the connected configuration and/or from the connected configuration to the disconnected configuration in order to minimize thermal shocks in the assignable cooling radiator (36).

14 Claims, 2 Drawing Sheets

THERMAL ENERGY MANAGEMENT SYSTEM FOR A VEHICLE HEAT ENGINE PROVIDED WITH A TIME-DELAY SWITCHING MEANS

FIELD OF THE INVENTION

The invention concerns a thermal energy management system for a vehicle engine provided with two heat carrier fluid circuits.

It concerns more particularly a thermal energy management system developed for an automotive vehicle heat engine, provided with a high-temperature circuit including the vehicle engine and a cooling radiator, as well as a low-temperature circuit including a low-temperature cooling radiator.

BACKGROUND OF THE INVENTION

A thermal energy management system of this type is already known (U.S. Pat. No. 5,353,757). It includes a unique cooling radiator that can be split in two parts by switching means controlled by a control box. The system can take a first configuration by which part of the radiator is allocated to the high-temperature circuit, while the other part is allocated to the low-temperature circuit. Or, the totality of the radiator exchange surface can be allocated to the high-temperature circuit or to the low-temperature circuit.

In such a thermal energy management system, the passage from one configuration to another takes place abruptly as certain control parameters are met or not. Thermal shocks are the result of this especially when switching from one configuration in which a portion or all of the cooling radiator contains water at a high-temperature, between 85° C. and 100° C. since it is linked to the high-temperature circuit, to a configuration in which this water is injected into the low-temperature circuit where the temperature is lower, for example within 40° C. and 60° C.

In addition, when all of the radiator exchange surface is allocated to one of the circuits, the other circuit does not have any cooling surface available. Such a configuration is not satisfactory from the high and low-temperature circuit cooling needs point of view.

The invention has for object a thermal energy management system to remedy these inconveniences. These objectives are reached from the fact that the management system includes an assignable cooling system, first switching means placed between the high-temperature circuit and the assignable radiator, second switching means placed between the low-temperature circuits and the assignable radiator to switch the system from one connected configuration, where the assignable radiator is connected to the low-temperature circuit, to a disconnected configuration, wherein said assignable radiator is connected to the high-temperature circuit and conversely, the switching means being sequentially operated after a time-delay while switching from the disconnected configuration to the connected configuration and/or from the connected configuration to the disconnected configuration in order to minimize thermal shocks.

As a result of these characteristics, the high-temperature water from the high-temperature circuit progressively passes to the low-temperature circuit while switching from the disconnected configuration to the connected configuration and, conversely, the cold water of the low-temperature circuit progressively passes to the high-temperature circuit in case the connected configuration passes to disconnected configuration.

In addition, no matter the configuration, each of the high- and low-temperature circuits maintains its own cooling capacity.

SUMMARY OF THE INVENTION

In one particular embodiment, the management system includes a high-temperature fluid input line that brings in the heat carrier fluid from the high-temperature circuit to the assignable radiator and a high-temperature fluid output line that takes it back from the radiator assignable to the high-temperature circuit; a low-temperature fluid input line that brings in the heat carrier fluid from the low-temperature circuit to the assignable radiator and a low-temperature fluid output line that takes it back from the radiator assignable to the low-temperature circuit; first and second switching means being inserted on the high-temperature fluid input line and on the low-temperature fluid output line, respectively.

In a preferred embodiment, the low-temperature fluid output line is linked to the low-temperature circuit upstream from a low-temperature radiator section, third switching means being mounted on the low-temperature circuit between the beginning of the low-temperature fluid input line and the arrival of the low-temperature fluid output line.

In this way, the third switching means help placing the assignable radiator in series with the low-temperature cooling radiator in the system Connected configuration.

However, in an embodiment variation, the assignable radiator and the low-temperature cooling radiator could be mounted in parallel. In this case, the presence of the third switching means would not be necessary.

Advantageously, the switching means are controlled by a control unit, at least one sensor supplying at least one control parameter representing the cooling needs of the high-temperature circuit and/or low-temperature circuit to the control unit.

The control parameter is advantageously chosen among the group including at least the temperature of the high-temperature circuit heat carrier fluid at the engine output, an engine load parameter and a parameter for knowing the engine load status.

In a preferred embodiment, the control unit uses a control flowchart that puts the system in a configuration connected to the vehicle startup, which reads the control parameter and compares it to a low-threshold value, the system being maintained in Connected configuration as long as the read parameter value is lower than that of the low-threshold value. Preferably, the flowchart, after comparing the control parameter to a low-threshold value, compares this parameter to a low-threshold value and places the system in Disconnected configuration if the parameter value is higher than that of the low-threshold value.

The system remains in disconnected configuration as long as the parameter value remains higher than the low-threshold value. In providing a low-threshold and a low-threshold, the system instability is prevented while avoiding the continuous switching from one configuration to the other as soon as a threshold value is reached.

In order to avoid thermal shocks in case of switching from the disconnected configuration to the connected configuration, the flowchart controls immediately the switching of the first switching means when comparing the control parameter value to the low-threshold determines that this parameter is less than the low-threshold value, then the switching of the second switching means with a first time-delay, and finally the switching of the third switching means with a second time-delay higher than the first time-delay.

On the contrary, in case of passage from the connected configuration to the disconnected configuration, the flowchart can immediately control the switching of the first, second and third switching means when comparing of the control parameter value to the low-threshold determines that this parameter is higher than the low-threshold value. Alternatively, the control flowchart immediately controls the switching of the third switching means when comparing the control parameter value to the low-threshold determines that this parameter is higher than the low-threshold value, then the switching of the second switching means with a first time-delay and finally the switching of the first switching means with a second time-delay higher than the first time-delay.

Advantageously, the switching means are two-way electrovalves. However, other types of switching means, thermostatic or air-actuated could be used.

In an advantageous embodiment, the high-temperature radiator and the assignable radiator are provided as a unique exchanger divided into a high-temperature cooling section and an assignable cooling section. This embodiment is for decreasing the number of exchangers and consequently to increase the system compactness.

In a typical embodiment, the low-temperature circuit integrates a water-cooled condenser which is part of an air-conditioning circuit and/or a water-cooled supercharging air radiator.

Finally, the low-temperature radiator can advantageously be divided in a first and a second cooling section.

BRIEF DESCRIPTION OF THE DRAWINGS

Other characteristics and advantages of the invention will further appear through reading of the following description of embodiment example given as illustrative references in the figures in appendix. In these figures.

Figure 1:
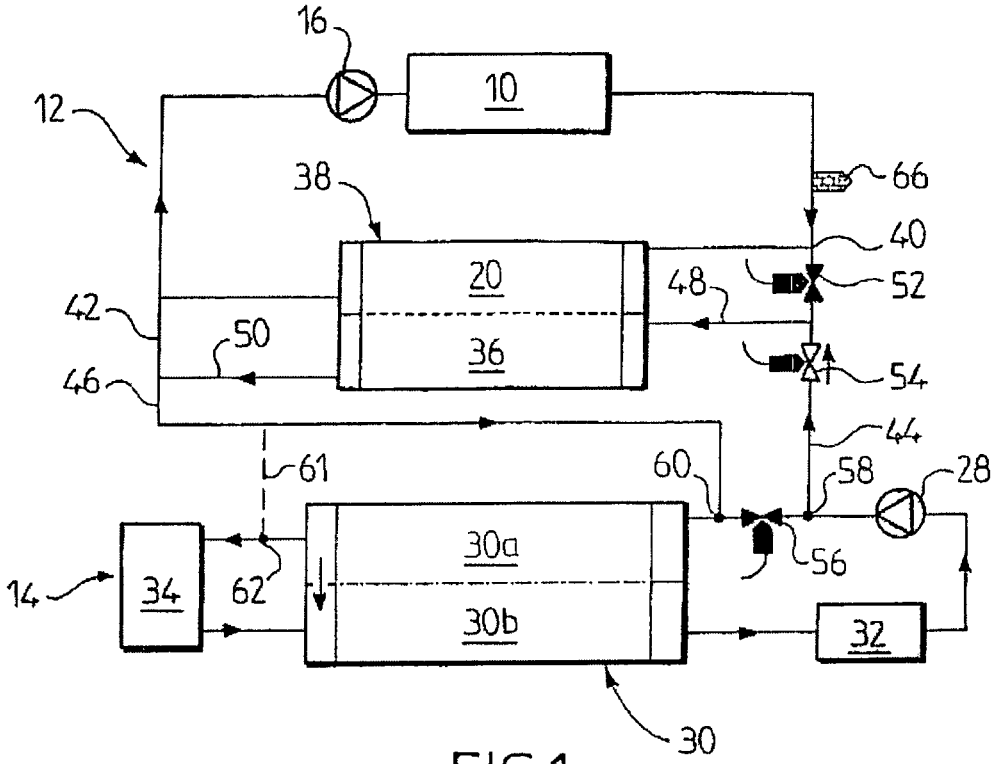
FIG. 1 is a diagram illustrating the principle of thermal energy management system complying with the invention represented in its connected configuration.

The thermal energy management system developed by engine 10 of an automotive vehicle includes a high-temperature circuit designated by reference 12 and a low-temperature circuit designated by reference 14. These two circuits form two interconnected loops through which run a same heat carrier fluid, for example water added with antifreeze such as ethylene glycol.

DETAILED DESCRIPTION

High-temperature circuit 12 includes a mechanical or electrical circulating pump 16 to run the heat carrier fluid. Traditionally, the circuit can include a thermostat or a thermostatic valve (not represented) placed at the engine output to circulate the heat carrier fluid, either through a bypass line (not represented), or through a high-temperature heat exchanger 20 which constitutes the vehicle main radiator.

The high-temperature circuit 12 can include other exchangers, i.e. an oil radiator, etc. However, as these elements are not pertinent to the invention, they are not represented.

The low-temperature circuit 14 includes a circulation pump 28, here electrical, and a low-temperature heat exchanger designated by the general reference 30. In the example, heat exchanger 30 (radiator) includes a first pass 30*a* and a second pass 30*b*. The low-temperature circuit 14 also includes a condenser 32 that is part of an air-conditioning circuit of the vehicle cabin. Contrary to the traditional condensers, condenser 32 is cooled by the low-temperature circuit heat carrier fluid. For this reason, among others, the fluid temperature in the low-temperature loop must be low, between about 40° C. to 60° C., in order to insure good performances for condenser 32. Finally, the low-temperature circuit 14 includes a supercharge air cooling 34 cooled by the low-temperature circuit heat carrier fluid.

On the other hand, the system of the invention includes an assignable cooling radiator 36 which can be linked, as we will explain in more details later, either to high-temperature circuit 12, or to low-temperature circuit 14. In an embodiment variation, assignable radiator 36 could constitute an independent unit separated from high-temperature radiator 20 and low-temperature radiator 30.

However, in the example represented, high-temperature radiator 20 and assignable radiator 36 constitute two independent sections of a unique heat exchanger designated by the general reference 38.

The system includes a high-temperature fluid input line 40 which brings the heat carrier fluid from high-temperature circuit 12 to assignable radiator 36 and a high-temperature output line 42 that brings it back from assignable radiator to the high-temperature circuit. Likewise, a low-temperature input line 44 brings the heat carrier fluid from low-temperature circuit 14 to assignable radiator 36 and a fluid output line 44 brings the heat carrier fluid back to the low-temperature circuit. In the example described, lines 40 and 44 end by a common portion 48, and lines 42 and 46 begin with a common portion 50 before dividing.

First switching means 52 are mounted on high-temperature fluid input line 40 and second switching means 54 are mounted on low-temperature fluid input line 44.

Finally, third switching means 56 are mounted 25 on low-temperature circuit 14 between starting point 58 of line 44 and end point 60 of line 46. In the example represented, end point 60 is located upstream from low-temperature radiator 30 as compared to the direction of fluid circulation 30 and, more specifically, upstream from pass 30*a*.

However, in an embodiment variation, as represented by dashed line 61, output line 46 could be connected to low-temperature circuit 14 at point 62 located downstream of pass 30*a*.

Figure 3:
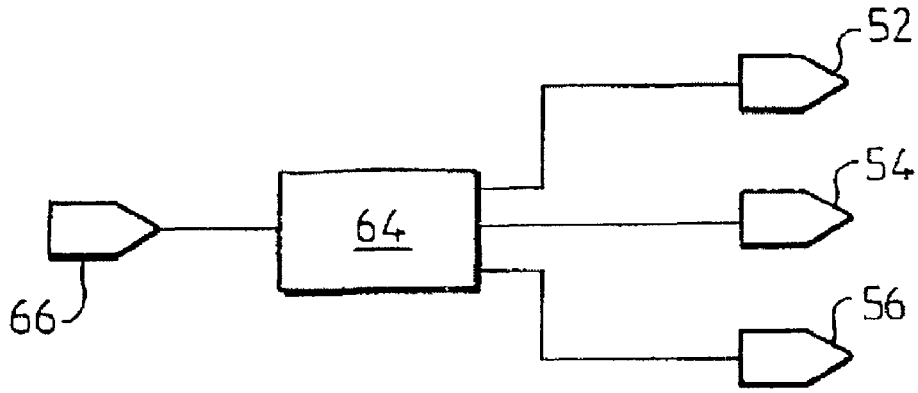
FIG. 3 illustrates the control of the switching means for the thermal energy management system in FIGS. 1 and 2.

Switching means 52, 54 and 56 can take different shapes. In the represented example, they are two-way electrovalves. These electrovalves can operate in a hit-or-miss mode or in a proportional mode. The electrovalves are controlled by a control unit 64 (FIG. 3). In that regard, a sensor measures a parameter representative, for example, of the engine cooling requirements.

In the example, sensor 66 takes the temperature of the heat carrier fluid (glycol water) at engine output 10. This parameter is the most appropriate. However, other parameters can be considered, as an engine load parameter or a parameter assessing the engine load status, as for example its output torque. A computation flowchart is implemented in control unit 64 in order to control the opening or closing of each electrovalve 52, 54, and 56.

In FIG. 1, the thermal energy management system of the invention has been represented in said "connected" position. In that configuration, assignable radiator 36 is linked to low-temperature cooling circuit 14. Electrovalve 52 and electrovalve 56 are closed while electrovalve 54 is open. In this way, assignable radiator 36 is mounted in series with pass 30*a* and pass 30*b*. If output line 46, instead of being connected to the low-temperature circuit at point 60 located upstream from pass 30*a*, is be connected downstream to the latter (point 62), cooling radiator 36 and pass 30*a* would be mounted in parallel and electrovalve 56 would not be necessary.

Figure 2:
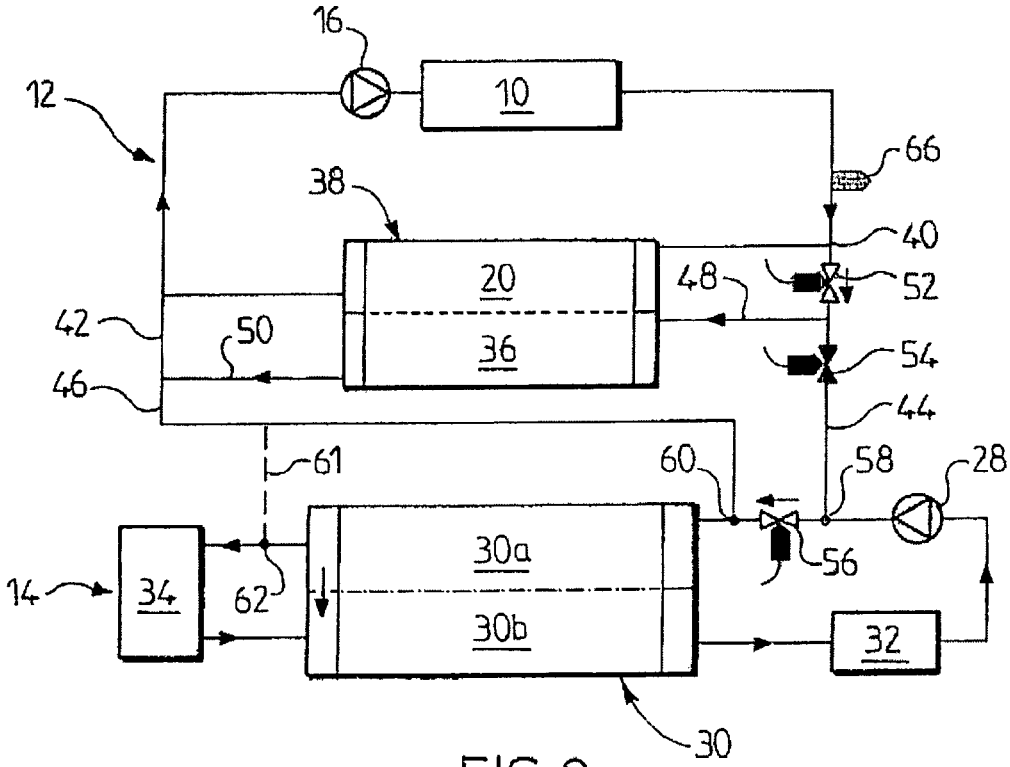
FIG. 2 is a diagram illustrating the principle of thermal energy management system of FIG. 1 in disconnected configuration.

FIG. 2 represents the configuration of the system in said "disconnected" position wherein assignable radiator 36 is part of the high-temperature circuit. In this configuration, electrovalves 52 and 56 are open, while electrovalve 54 is closed. Under these conditions, high-temperature radiator 20 and assignable cooling radiator 36 function in parallel. The cooling capacity of the assignable radiator adds to that of high-temperature radiator 20. On the other hand, the cooling capacity of the low-temperature circuit is limited to that of low-temperature radiator 30.

Figure 4:
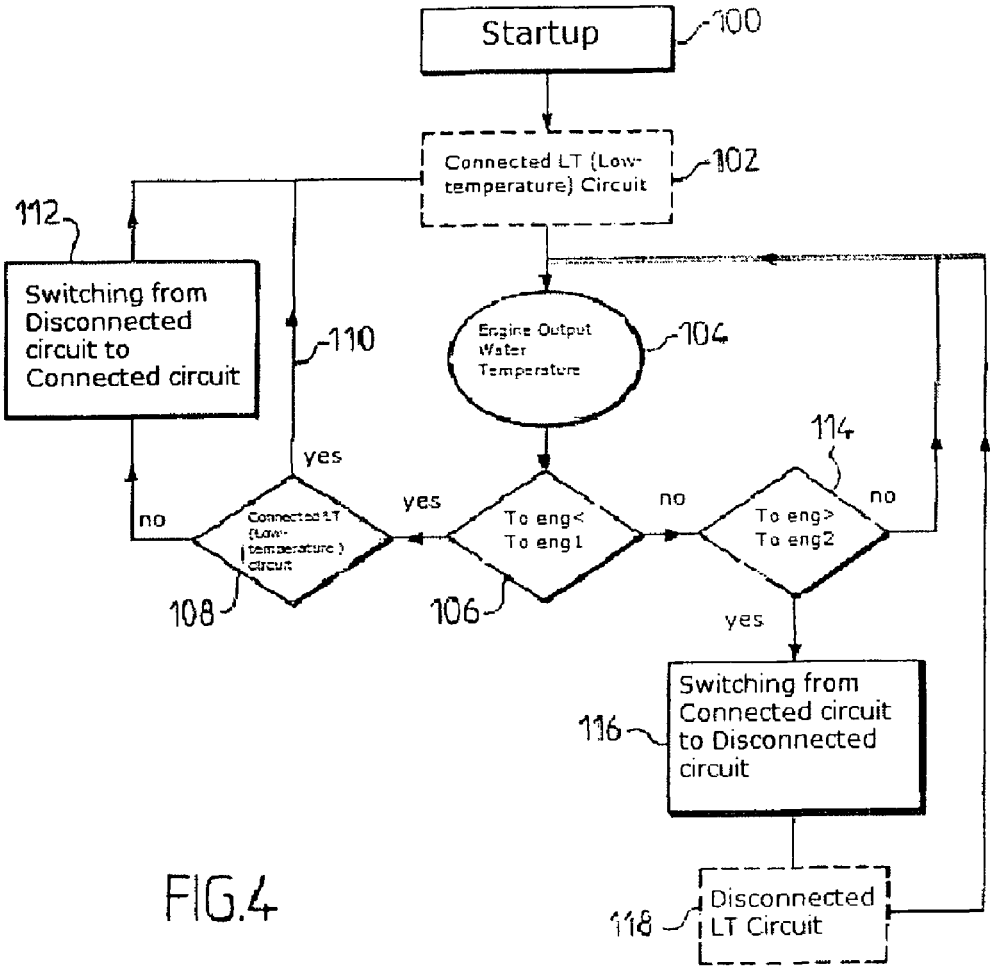
FIG. 4 is a control flowchart of the switching means for the thermal energy management system in FIGS. 1 and 2.

FIG. 4 illustrates an example of control flowchart for electrovalves 52, 54, and 56. When the engine starts up (reference 100), the system is by default in the "connected low-temperature (LT) circuit" configuration, as represented in step 102. Indeed, when the vehicle starts, the heat carrier fluid is cold and it is not desirable to cool it down in order to speed up the temperature rise of the engine.

In step 104, sensor 66 takes the water temperature (T water) at the engine output.

In step 106, the engine output water temperature (Ts mot) is compared to a low-threshold Ts mot 1, for example 85° C. If the comparison determines that the water temperature is lower than the low-threshold value, a test in step 108 is conducted to determine if the system is in Connected configuration or not. If it is, we come back to step 102, through a branch 110. If not, control unit 64, in step 112, controls the switching from disconnected configuration to connected configuration.

According to the invention, at time t, when the engine output water temperature has been detected as lower than the low-threshold value Ts mot 1, control unit 64 controls the closing of electrovalve 52.

From this fact, the high-temperature fluid can no longer penetrate in assignable cooling radiator 36.

After a specific time-delay T1, control unit 64 controls the opening of electrovalve 54. Therefore, a portion of the low-temperature fluid of low-temperature circuit 14 can be redirected to radiator 36, while the other portion of the low-temperature fluid continues to flow through electrovalve 56 still opened. In this way, radiator 36 progressively drains out the high-temperature fluid which is progressively replaced with a low-temperature fluid. Since this process is progressive, thermal shocks are avoided contrarily to what would happen if the three electrovalve switching would be controlled simultaneously.

Finally, after a second time-delay T2, control unit 64 closes electrovalve 56, which forces all low-temperature fluid to flow through the assignable radiator prior to its passage in pass 30*a* of radiator 30.

This done, switching the thermal energy management system from disconnected configuration to connected configuration is complete.

The system will remain permanently in connected configuration as long as the engine output water temperature remains lower than the low-threshold value.

If the engine output water temperature (Ts mot) rises above the low-threshold temperature, a second test is conducted in step 114 comparing this temperature to a low-threshold value Ts mot 2, for example 105° C. If the comparison determines that the engine output water temperature, while being higher than the low-threshold value, still remains lower than the low-threshold value, the configuration of the system is not modified.

In other words, if the system was first in connected configuration, it remains connected even if the water temperature, for example 100° C., is now above the low-threshold value. If, in step 114, the engine output water temperature is found to be over the low-threshold value Ts mot 2, control unit 64 controls the switch of the system from connected configuration to disconnected configuration.

To this effect, unit 64 controls the opening of electrovalve 52, the closing of electrovalve 54, and the opening of electrovalve 56.

In flowchart of FIG. 4, these operations occur simultaneously, meaning without set delays. However, in an embodiment variation, delays can also be set that could be equal to time-delays T1 and T2 defined for switching from disconnected configuration to connected configuration or that could be different.

In such case, the control unit controls the electrovalves in an order reverse with regard to that defined in step 112. In other words, electrovalve 56 is first opened, then electrovalve 54 is closed, and finally electrovalve 52 is opened. Once done, the system is in disconnected configuration as illustrated in step 118.

If the engine output water temperature goes again below low-threshold value Ts mot 2, the system does not immediately go back to connected configuration but remains in disconnected configuration as long as the water temperature does not fall below low-threshold value Ts mot 1. In this way, the possibility of setting a low-threshold and a low-threshold avoids the instability of the system and the continuous switching from one mode to the other.

The invention claimed is:

1. A thermal energy management system developed by an automotive vehicle thermal engine, comprising:

a high-temperature circuit including the vehicle engine and a high-temperature cooling radiator;

a low-temperature circuit including a low-temperature cooling radiator, wherein the high-temperature circuit and the low-temperature circuit are run through by a same heat carrier fluid;

an assignable cooling radiator;

first switching means inserted between the high-temperature circuit and the assignable cooling radiator; and second switching means inserted between the low-temperature circuit and the assignable cooling radiator in order to switch the system from a connected configuration in which the assignable cooling radiator is connected to the low-temperature circuit, to a disconnected configuration, in which the assignable cooling radiator is connected to the high-temperature circuit, and conversely from the disconnected configuration to the connected configuration, wherein the first and second switching means are sequentially operated after a time delay during the passage from the disconnected configuration to the connected configuration and from the connected configuration to the disconnected configuration, in order to minimize thermal shocks.

2. The management system according to claim 1, further comprising:

a high-temperature fluid input line that brings the heat carrier fluid from high-temperature circuit to assignable radiator;

a high-temperature fluid output line that brings it back from assignable radiator to high-temperature circuit;

a low-temperature fluid input line (44) that brings the heat carrier fluid from low-temperature circuit to assignable radiator; and a low-temperature fluid output line that brings it back from assignable radiator to low-temperature circuit, wherein the first and second switching means are respectively inserted on the high-temperature fluid input line and on the low-temperature fluid output line.

3. The management system according to claim 2, characterized in that low-temperature fluid output line (46) is linked to low-temperature circuit (14) upstream from a section (30*a*) of low-temperature radiator (30), third switching means (56) being mounted on the low-temperature circuit between beginning (58) of the low-temperature fluid input line and end (60) of the low-temperature fluid output line.

4. The management system according to claim 1, wherein the first and second switching means are controlled by a control unit, and at least one sensor supplying at least one control parameter representative of the cooling needs of the high-temperature circuit and the low-temperature circuit to the control unit.

5. The management system according to claim 4, wherein the control parameter is chosen among the group comprising at least the heat carrier fluid temperature at engine output, an engine load parameter, and a parameter for knowing the engine load status.

6. The management system according to claim 4, wherein the control unit uses a control flowchart that puts the system in the connected configuration as the vehicle starts up, reads the control parameter and compares the control parameter to a low-threshold value, wherein the system is maintained in connected configuration as long as the control parameter value read is lower than the low-threshold value.

7. The management system according to claim 6, wherein the control flowchart, after comparing the control parameter to a low-threshold value, compares the control parameter to a low-threshold value and places the system in the disconnected configuration when the control parameter value is higher than the low-threshold value.

8. The management system according to claim 7, wherein the control flowchart immediately controls the switching of first switching means after determining by comparison that the low-threshold control parameter value is lower than the low-threshold value, and second, controls the second switching means with a first time-delay (T1), and third, switches the third switching means with a second time-delay (T2) higher than the first time-delay (T1).

9. The management system according to claim 6, wherein the control flowchart immediately controls the switching of the first, second, and third switching means after determining by comparison that the low-threshold control parameter value is higher than the low-threshold value.

10. The management system according to claim 6, wherein the control flowchart immediately controls the switching of the third switching means after determining by comparison that the low-threshold control parameter value is higher than the low-threshold value, and second, controls the switching of the second switching means with a first time-delay (T1), and third, controls the switching of time-delay (T2) greater than the first time-delay (T1).

11. The management system according to claim 1, wherein the first and second switching means are two-ways electrovalves.

12. The management system according to claim 1, wherein the high-temperature radiator and the assignable cooling radiator are realized as a unique exchanger divided into a high-temperature cooling section and an assignable cooling section.

13. The management system according to claim 1, wherein the low-temperature circuit includes a water-cooled condenser which is part of an air-conditioning circuit and a water cooled supercharging air radiator.

14. The management system according to claim 1, wherein the low-temperature radiator is divided in a first and a second cooling passes.

* * * * *